United States Patent [19]

Bradley et al.

[11] Patent Number: 4,579,169

[45] Date of Patent: Apr. 1, 1986

[54] CONTINUOUS CASTING BAND SYSTEM

[75] Inventors: Gary W. Bradley, Carrollton; Alexander N. Morrison, Douglasville, both of Ga.

[73] Assignee: Southwire Company, Carrollton, Ga.

[21] Appl. No.: 144,802

[22] Filed: Apr. 29, 1980

[51] Int. Cl.[4] ..... B22D 11/06

[52] U.S. Cl. ..... 164/481; 164/482; 164/432; 164/433

[58] Field of Search ..... 164/87, 137, 431, 432, 164/433, 339, 481, 482; 29/402.08, 426.3, 426.1; 198/812; 242/86.52, 58.6

[56] References Cited

U.S. PATENT DOCUMENTS

| | | | |
|---|---|---|---|
| 2,846,051 | 8/1958 | Craggs et al. | 198/812 |
| 3,341,139 | 9/1967 | La Tour | 242/55 |
| 3,506,210 | 4/1970 | La Tour et al. | 242/55 |
| 3,628,742 | 12/1971 | Fritzsche | 242/55 |
| 3,682,234 | 8/1972 | Vogel | 164/433 |
| 3,749,150 | 7/1973 | Properzi | 164/433 |
| 3,888,430 | 6/1975 | Costello et al. | 242/55 |
| 3,938,580 | 2/1976 | Donini | 164/433 X |
| 4,030,537 | 6/1977 | Ward | 164/433 |
| 4,086,982 | 5/1978 | Olsson | 164/88 |
| 4,172,490 | 10/1979 | Ware | 164/433 |
| 4,227,660 | 10/1980 | Denny et al. | 198/812 |

FOREIGN PATENT DOCUMENTS

| | | | |
|---|---|---|---|
| 2271 | 1/1970 | Japan | 164/433 |
| 10178 | 5/1970 | Japan | 164/433 |

OTHER PUBLICATIONS

*Iron and Steel Engineer,* vol. 55, No. 9, Sep. 1978, p. 79.

*Metal Producing,* vol. 16, No. 10, Oct. 1978, p. 25.

Costello, Tony, "Technology for Eliminating Roll Forming Downtime," *Precision Metal,* vol. 38, No. 5, May 1980, pp. 39–41.

*Primary Examiner*—Nicholas P. Godici

*Attorney, Agent, or Firm*—Herbert M. Hanegan

[57] ABSTRACT

An improved apparatus and method for the recycling accumulation of at least one moving continuous band in a continuous molten metal casting machine of the type having continuously advancing mold parts, at least one of which is formed by said band and wherein at a station located in a spaced relationship to said casting machine, the elongated continuous band, belt, or strip is accumulated from the mold end and simultaneously fed out or supplied to the mold beginning. In combination therewith are the use of means to properly tension said band or bands, and means to join the ends thereof to new lengths of band, belt, or strip so as to connect a substantially unlimited number of individual elongated belts to the one in use. The apparatus is configured to permit incorporation into newly designed apparatus or retrofitting for use with a great many of the various continuous metal casting machines of past and present manufacture wherein at least one of the mold surfaces is formed by a band, belt, or strip moving in close contact with the cast metal.

9 Claims, 11 Drawing Figures

CONTINUOUS CASTING BAND SYSTEM

TECHNICAL FIELD

The present invention relates to the molten metal casting arts, especially to continuous casting apparatus employing one or more belts, strips, or bands (hereinafter "bands") to form one or more mold surfaces which travel in contact with the solidifying metal. As a key component of such casting systems, the belt or band, which is often formed from thin steel, copper or other sheet or strip material, is subjected to extremes of heating and cooling while under great tension, and while traveling cyclicly through the casting system, and is often subjected to many curvatures formed by one or more idler, tension, steering, and/or casting wheels and rollers.

BACKGROUND OF THE INVENTION

In one such typical system for continuously casting a high temperature molten metal, an endless flexible metal band is guided about one or more generally fixed idler or tension wheels and a portion of the peripheral groove of a casting wheel rotatable by an external drive mechanism about a fixed axis. The molten metal to be cast is poured in a continuous manner into the moving mold portion of the casting apparatus, which mold is formed by the band covering a portion of the peripheral groove in the casting wheel. Coolant is applied to the mold surfaces to functionally extract the heat from the molten metal at a rapid rate to both solidify the metal and to prevent the mold surfaces from overheating. At the time the metal band is removed from the peripheral groove of the casting wheel by the band guide wheels, the previously molten metal is sufficiently solidified to permit extraction thereof from the casting wheel and to be guided to a succeeding stage in the production process.

Parallel moving belts with fixed or movable side dams or mold blocks are also used in continuous molten metal casting. Here, two relatively short metal bands—perhaps as great as 100 inches (2.54 m) in width—form the major moving mold walls which travel in contact with the metal as it is being cast. In some configurations, the side dams or mold blocks are replaced by two additional parallel moving belts which may be sealed by any of various means to prevent escape of the molten metal. In another form, the edges of two generally parallel belts are merely brought into sealing contact to prevent molten metal leakage. In yet another moving belt metal casting apparatus the mold is comprised of a single belt formed into a closed mold, sealed at the edges, and opening after the metal has solidified.

Multiple moving parallel belt continuous casting machines are well-known in the metal casting art. One such casting apparatus is described in detail in "The Present Status of Continuous Casting Between Moving Flexible Belts," by R. W. Hazelett, appearing in *Iron and Steel Engineer,* June 1966, pp. 105–110.

Apparatus of the foregoing types are typified by casting means of the type disclosed in U.S. Pat. Nos. 359,348; 368,817; 594,583; 1,841,297; 2,640,235; 2,659,948; 3,279,000; 3,452,809; and 3,703,204. These patents are identified as typical of the various prior art continuous casting apparatus which include one or more moving belts, bands, or strips forming at least one wall of a continuously advancing mold moving in contact with the metal as it solidifies. U.S. Pat. No. 3,682,234 shows a prior art use of and definition for a "Mobius strip" (see Col. 4, line 61 et seq.).

Definitions used herein are as follows:

"Continuous casting" refers to essentially uninterrupted casting operations except for maintenance or scheduled stops.

"Endless band" refers to a casting band which is formed into a continuous loop having joined ends and which is uninterrupted except for band change operations when it may be briefly interrupted by severing so as to replace an old band or old band section with new band material.

"Rotating convolute coil" refers to a coil of band or strip material which may be rotated on an axis through the center of the coil; unless otherwise specified, the orientation of the coil axis (vertical, horizontal, etc.) is undetermined.

A key component in the operation of such molten metal casting apparatus is the casting band or bands. Extending band life therefore functions to reduce operating down time, maintenance time, operating and maintenance costs, and even product quality. Unnecessary energy use and costs associated with maintaining raw materials in a molten state during band change and start up are eliminated or reduced significantly. Other systemic advantages accompany extended band life, including longer component lifetimes for thermally cycled system parts (pots, launders, pour spouts, casting and tension wheels, furnaces, and burners), greater overall productivity, reduced scrap production, longer life of rolling mill rolls (due to fewer start ups) and a product having improved quality.

In the operation of the previously identified casting apparatus, one of the major problems is the care, maintenance, and replacement of the band or bands. Due to the need to form the band into arcs to pass around the tension/idler/guide and/or casting wheels, it must be made of flexible material. Additionally, thinner bands permit more efficient transfer of heat from the molten metal than thick bands, while incurring only two drawbacks. First, thin bands which are under lengthwise tension are more subject to band tensioning difficulties, and second, short thin bands undergo more severe thermal cycling, thus compounding tensioning difficulties. The most common failure modes for bands are due to thermal and mechanical stresses; the mutual effects of these stresses must be carefully considered when selecting materials for casting bands. It should be noted that U.S. Pat. No. 4,172,490, assigned to the assignee of the present invention, improved band life over the simpler, shorter length bands cited earlier, by enabling a longer band to be used in combination with a constant tension. Band life was thereby typically extended by a factor of 10 or less. Even so, other factors to be considered when selecting materials for casting bands include band cost, cost of preparation, ease of installation, band life, and heat extraction efficiency—the latter being of special importance in the casting of high temperature metals and alloys containing elements of differing solidification temperatures as well as production rates. Other prior art attempts to increase band length and life are represented by Japanese Publication No. UM10178 and the article "Model Concept Mini Steel Plant Announced for Pittsburgh Area," which appeared at page 79 of the September 1978 issue of *Iron and Steel Engineer* (see FIG. 1 thereof). Both publications reveal so-called "serpentine" bands having a multiplicity of additional rollers to store the band. However, due to the multiplicity of additional rollers, multiple additional bending strains are introduced which substantially reduce the increased band life otherwise anticipated by longer bands.

Bands for casting machines have generally been selected from among very low carbon steel alloys and copper and copper alloys when casting molten metals (see also U.S. Pat. No. 4,042,009). One commonly used band material is A.I.S.I. 1006 or 1008 grade low carbon steel, selected for its good tensile strength (40,000 to 60,000 p.s.i.), low linear expansion, easily joined ends (TIG welding proves durable), low cost, and numerous other advantages. However, conventional length bands of this material have been characterized by comparatively short lifetimes, especially if improperly tensioned. Such improper tensioning may also result in lowered thermal efficiency and a tendency to distort the draft angle of the casting wheel when tension is excessive, which results in difficulty in extracting the cast bar and requires early replacement of the relatively expensive casting wheel.

Prior art extended band length molten metal casting apparatus includes that of Properzi in U.S. Pat. No. 3,749,150, wherein a noncontinuous length band is supplied to a wheel-band casting apparatus and taken up therefrom on a separate take up reel. Such apparatus was intended for relatively short duration (approximately one work shift) operation. Also included would be the wheel/band casting apparatus of Donini in U.S. Pat. No. 3,938,580, in which an extensible band of shorter length is utilized. U.S. Pat. No. 4,172,490, previously identified, enables multiplying the casting band length but by only a few times. Quite long and thin bands, backed by thicker support bands, are disclosed in U.S. Pat. No. 4,030,537 to Ward. Other apparatus known in the art include Japanese Published Application No. 45-2271 (1970), similar to that of Properzi, above. All of the preceeding fail to accomplish at least one of the following two areas of need: extremely long (1) continuous (2) casting bands.

SUMMARY OF THE INVENTION

The present invention comprises a continuous molten metal casting machine of the conventional type in which at least one of the mold surfaces is an elongated endless belt, band, or strip moving in contact with the metal cast; band reservoir means to accept, accumulate, and pay out the band such that the band is supplied to the mold and withdrawn therefrom at a regular rate, suitable tension means to provide the proper tension to the band before entering the mold and after exiting the mold, and in one alternate embodiment hereof, means to sever the used band and join thereto a completely new continuous band.

By configuring the present band as a "Mobius strip", extremely long new-face bands may be presented to the casting machine mold face. A Mobius strip is conventionally comprised of an elongated strip or band having two major parallel faces in which one end of the strip is twisted 180 degrees and joined to the other end such that the first face is joined to the second face at the junction and vice-versa.

The advantages ascribed to most copper and copper alloy bands are believed to be overstated and of lesser significance in view of the present invention.

It has been noted that the Ware patent (U.S. Pat. No. 4,172,490) increased the life of casting bands; the present invention improves on the Ware patent by greatly extending band length—the extension provided by this invention is comparatively unlimited for the space it occupies—but additionally, in an alternate embodiment combines the ability to join a new length of band material to the severed end of the used band to replace the used band in its entirety without interruption of the continuous casting operation.

High temperature molten metal casting rapidly deteriorates the steel band surface, expecially as molten metal temperatures rise to 2000° F. (1110° C.) and above. Therefore, it would be a useful improvement in the art to provide extremely long casting bands as this would improve productivity. Further, due to the rapid band deterioration, apparatus as disclosed in an alternate embodiment of the present invention provides a means by which worn-out casting bands may be replaced without interrupting the continuous casting operation.

It is therefore an object of the present invention to provide molten metal continuous casting apparatus of the type described wherein an endless casting band having a length substantially greater than prior art bands may be continuously reused to eliminate unplanned interruptions of the casting operation for band replacement and to greatly reduce the routine interruption for band replacement, and to thereby greatly increase casting machine operational availability and improve productivity.

Another object is the provision of endless long band apparatus which may be readily incorporated into existing designs or retrofitted to prior installations.

Still another object of this invention is the provision of apparatus to provide a constant tension to that portion of the greatly elongated endless band which encompasses the casting mold.

Another object of the present invention is to movingly store an unexpectedly long length of continuous conventional casting band material up to 100 inches (2.54 m) wide and several thousand feet (or meters) in length.

Yet another object of the invention disclosed herein is the provision for changing an endless casting band without interrupting the continuous casting process.

Still another object is the storage of a long, continuously advancing endless casting band which storage apparatus avoids sharp bend angles.

And still another object is the storage of a long, continuously advancing endless casting band in storage apparatus which avoids scratches caused by moving bands coming into abrasive contact with one another or other objects.

Another object of this invention is to enable more efficient, continuous casting of metals such as those which reach the molten state above 2000° F. (1110° C.), at which temperature extremely rapid deterioration of conventional short bands occurs.

Yet another object is the improvement of cast bar surface quality derived from the relatively smoother band surface provided by the combination of configuring the band of the present invention as a "Mobius Strip" and an extremely long band.

Still another object is to provide maximum length bands in a minimum size working area adjacent the casting apparatus.

Finally, it is an object of this invention to provide endless, comparatively unlimited length casting bands of great width for use with continuous casting mold apparatus.

BRIEF DESCRIPTION OF THE DRAWINGS

Numerous other features and advantages of the invention disclosed herein will be apparent upon an examination of the several drawing figures forming a part hereof and in which like reference characters indicate corresponding parts in all views. To avoid redundancy of descriptions, lower case letters are used as suffixes to reference numerals to indicate similar items or apparatus. A prime symbol (') following a reference numeral indicates a substantially identical item or apparatus, the added description of which would be redundant. The double prime symbol (") is used similarly. The band or bands are usually shown as a line to represent their longitudinal dimension only; thickness and width are omitted from the illustrations to avoid dimensional confusion.

DETAILED DESCRIPTION OF THE INVENTION

Figure 1:
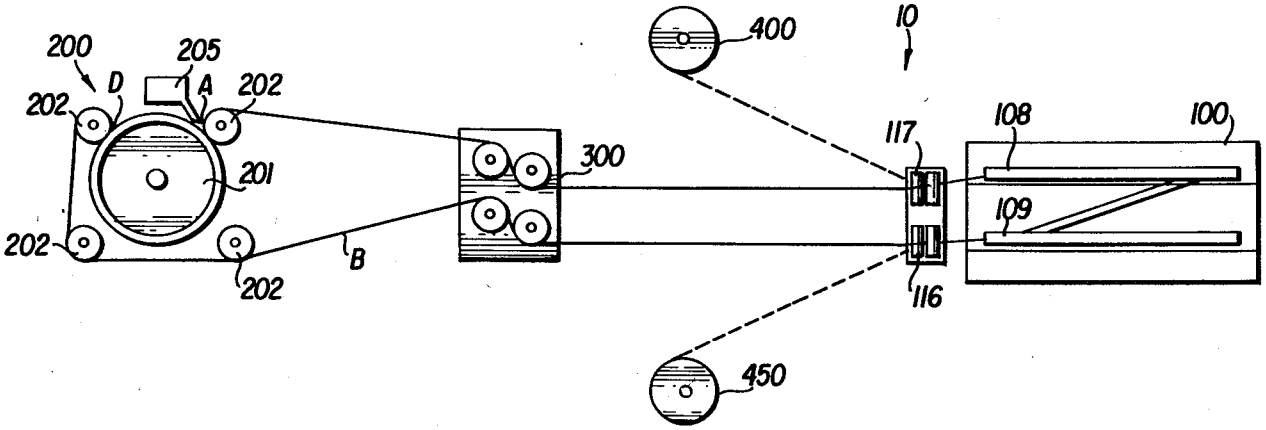
FIG. 1 is a schematic illustration of a basic embodiment of this invention.
Figure 2:
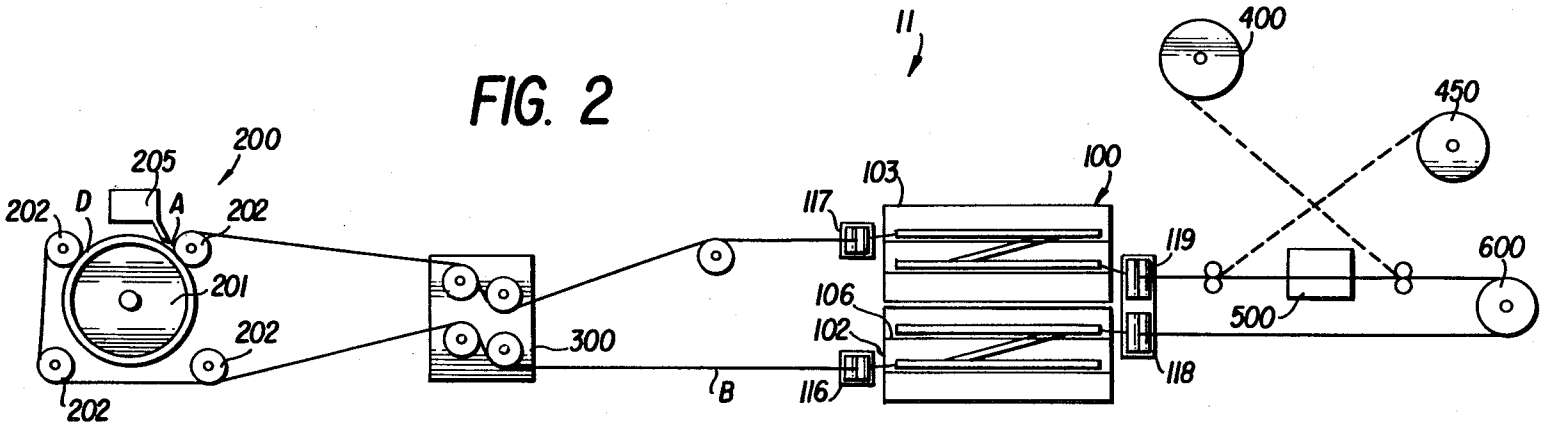
FIG. 2 is a schematic illustration of an alternate embodiment of this invention identified as the continuously renewable continuous casting band apparatus.

There is schematically illustrated in FIGS. 1 and 2 a wheel-belt type of continuous casting machine 200 comprising a rotatably mounted casting wheel 201 and an endless band B adapted for continuous movement around at least one band support wheel 202. 205 is a molten metal receiving tundish. The band B and casting wheel 201 are mutually disposed and arranged so that along a portion of their respective paths the band B contacts the casting wheel 201 by moving in contact with a peripheral groove inscribed upon the surface of the casting wheel 201 so as to define between them a closed mold having an inlet at point A where the band B and wheel 201 meet circumjacent a band guide wheel 202. The mold is continued through an arc of the casting wheel rotation until the band is separated from the casting wheel 201 by a band guide wheel 202 at mold exit point D. Molten metal is supplied to the mold inlet A of the casting mold through tundish 205 or other known means. As the metal and the mold formed by wheel 201 and band B move through the mold arc of the apparatus, the molten metal is cooled by known means and solidifies into a continuous cast bar which emerges continuously from the mold exit D. To promote solidification, coolant means (not shown) are provided which impinge liquid coolant against the surface of the band B along the mold arc. Desired cooling rates at the band side of the mold may be selected through known means or by bands having varying thickness, for example, from 0.01 to 0.375 inches in thickness. Other cooling means (not shown) are arranged to supply coolant to the surfaces of the casting wheel 201 along the mold arc.

More specifically, the continuous casting band apparatus 10 shown in FIG. 1 consists essentially of a casting apparatus such as wheel-band casting machine 200, band tension control means 300, pinch rolls as may be required, and a band reservoir station 100 such as will be described herein. Incident to these operating portions of the apparatus are spent band takeup station 400 and new band supply station 450 for convenient changing of the band B. Such a configuration is illustrated in FIG. 1.

The long band continuous metal casting apparatus 10 configuration disclosed in FIG. 1 contemplates band B exiting the top level (coil 108) of an accumulator/payout means which in this configuration comprises reservoir station 100, traveling through exit reservoir pinch rolls 117 to tension apparatus 300, thence to the casting machine 200 where it passes around band guide wheel 202 at mold inlet A, around casting wheel 201 to the mold outlet and around another band guide wheel 202 which removes the band from the wheel 201. The band B may be guided around further band support wheels 202 in continuing its return path to and through the tension apparatus 300. From tension apparatus 300 the band B passes through entry pinch rollers 116, and to the lower level of reservoir station 100. The functional description of reservoir station 100 is described below in association with FIGS. 3, 4 and 5. Spent band takeup station 400 and new band supply station 450 store extra band material for replacement purposes and withdraw old used band material from the apparatus during band change maintenance operations. In the configuration of FIG. 1, fixed, portable, or mobile band shear and welding apparatus (not shown) are used for the infrequent periodic band changes which can readily occur during other scheduled maintenance periods. It should be noted that the band travel within the reservoir station 100 can be in either direction, i.e., the band B can also enter the top level (coil 108) and exit from the bottom level (coil 109) if so desired. Directional translation pinch rollers (not shown) may be used to twist the band B material 90 degrees from its horizontal orientation to the vertical orientation required for storing band B on its narrow edge as is described below.

Alternatively, another embodiment of this invention (FIG. 2) contemplates a continuously renewable continuous casting band apparatus configuration 11 in which a pair of accumulator/payout means 102, 103, required for each band utilized, comprise the reservoir station 100. In this configuration a turnaround sheave 600 is located in a spaced relationship from reservoir station 100 with band B material passing to and around the turnaround sheave 600 and on to a band shear and weld station 500. Band clamp means (not shown) are used to hold the band B in place for the severing and welding operations. Fresh band material is supplied from new band supply station 450 and spent band takeup apparatus 400 is provided as in embodiment 10 described above.

Operation of the casting machine 200 and tension apparatus 300 is substantially similar to that previously described in connection with FIG. 1. Returning from the tension apparatus 300, band B enters the first (lower) accumulator/payout means 102 which functions in the manner as described following in association with FIGS. 3, 4, and 5. Reservoir entry pinch rolls 116 are provided near the entrance to accumulator/payout means 102; intermediate exit pinch rolls 118 are provided at the lower middle table 106 exit to hold band B, which is then routed to and partially around a turnaround sheave 600. From turnaround sheave 600, band B enters a band shear and weld station 500 which may be either fixed, portable or mobile. During normal operation, band B travels through this station largely unaffected, arriving thereafter at intermediate entry pinch rolls 119 at the entrance to upper accumulator/payout means 103. During band renewal operations, however, band B may be halted (by clamping intermediate pinch rolls 118, 119 or other band clamping means) while band B is thereby halted at shear and weld station 500. Band shear and weld station 500 is comprised of means to sever the band (not shown), mechanical, optical, or otherwise; and welding means to metallurgically join the band ends (not shown), which welding means may be by electrical arc, chemical reaction, wave energy, or otherwise. Accumulator/payout means 102 continuously accumulates incoming band B and accumulator/-payout means 103 is continuously depleted thus permitting continued supply of band B to the tension apparatus 300 and casting machine 200. While the band is halted at shear and weld station 500, it is severed; the leading edge is directed to and attached to spent band takeup station 400, and the leading edge of a strip of unused band material is taken from new band supply station 450 and joined to the trailing edge of the old band B forming a welded junction (not shown). Then the new band material B is permitted to travel through the entire apparatus 11 until the welded junction of old and new again reaches shear and weld station 500. New band material is accumulated faster than depletion to supply the new band. At this point an initial small portion of the once-used new band B is permitted to pass through the shear 500 and on to takeup 400 whereupon the band B is severed, creating a leading edge of the once-used new band. The unused band from supply station 450 is also severed and the resultant trailing end joined to the once-used leading edge of new band B by welding at shear and weld station 500. Band B is thus renewed without interruption of the casting process.

Figure 3:
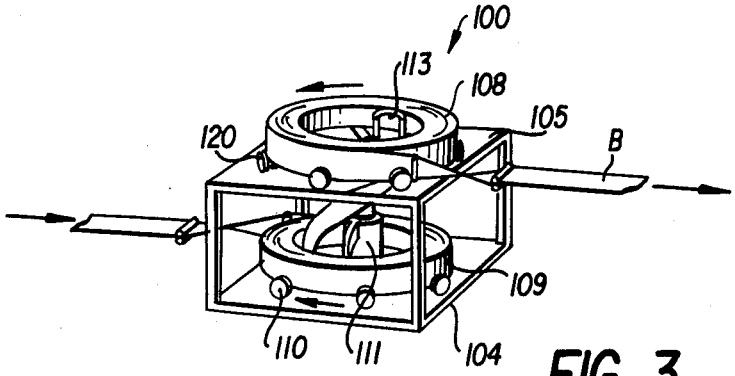
FIG. 3 is a perspective view of the band reservoir station.

It should be noted that in the first embodiment described above in connection with FIG. 1, the band material enters and exits the reservoir station on the same side (see also FIGS. 4*a* and 5), while in the continuously renewable continuous casting band configuration of FIG. 2 the band B would usually enter from one side and exit the opposite side as shown in FIG. 3.

The relative advantages of the two major configurations disclosed in FIGS. 1 and 2 are related to molten metal temperatures and corrosivity and capital considerations. The continuous casting band apparatus 10, for example, is preferable for use with aluminum or lower volume copper casting apparatus since the relatively low molten metal temperatures encountered would extend band change intervals beyond scheduled maintenance intervals which are often, for example but not limitation, weekly or fortnightly. For high speed and-/or high volume continuous casting of molten metals having perhaps higher temperatures or which are more corrosive, the continuously renewable continuous casting band apparatus 11 would enable continuous casting operations uninterrupted by band change maintenance, thus substantially eliminating concern over band wear during production operations.

Figure 4A:
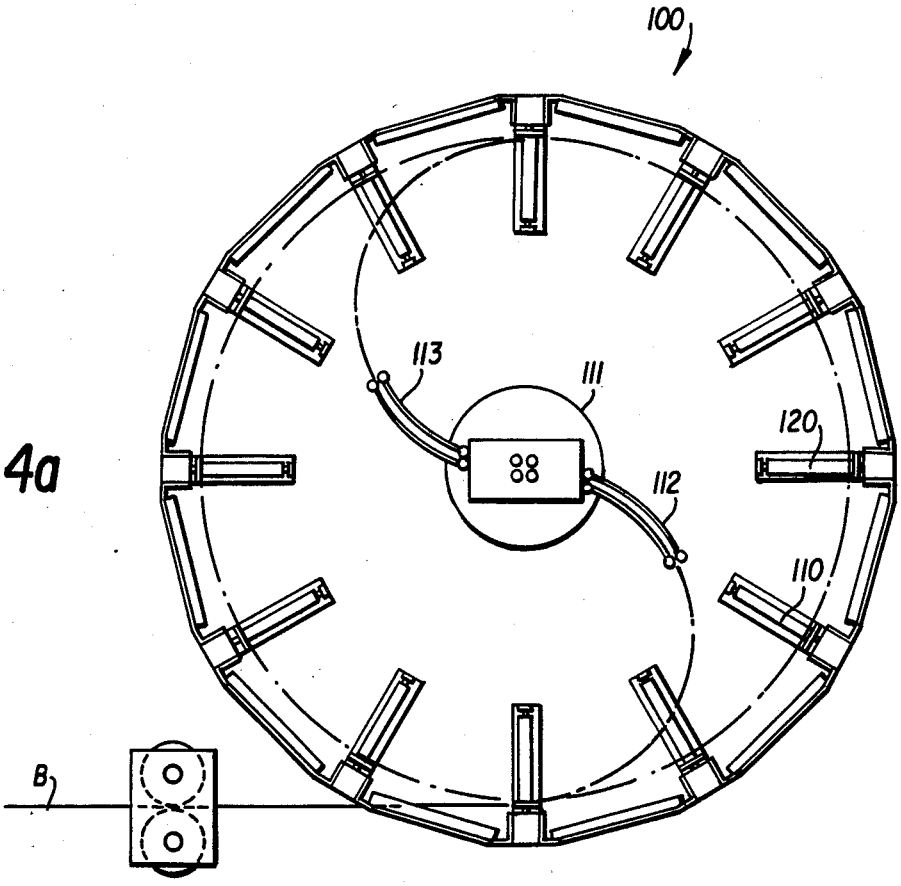
FIG. 4*a* is a plan view of the band reservoir station.
Figure 4B:
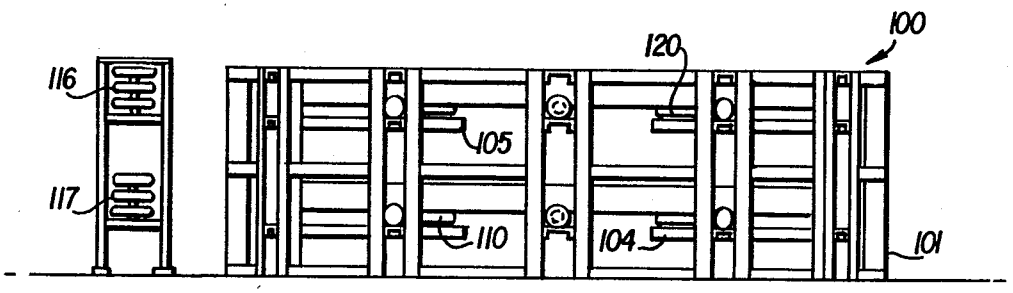
FIG. 4*b* is an elevation view of the band reservoir station.
Figure 5:
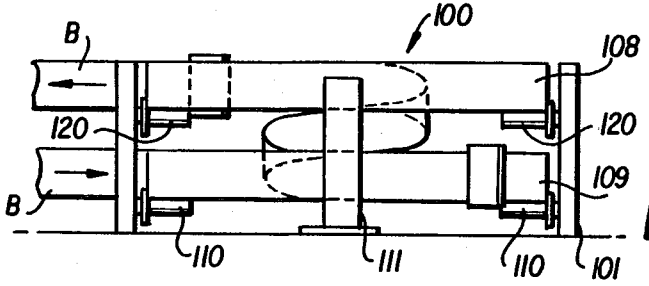
FIG. 5 is a simplified elevation view.

Referring now to FIGS. 3, 4*a*, 4*b*, and 5, it may be seen that the basic reservoir station 100 as used in FIG. 1 (comprising a single accumulator/payout means 101) consists essentially of two stacked coaxial coils 108, 109 of band material, each of which is supported by and retained in place by a plurality of flanged support rollers 120 and 110. Two stacked coil tables having open central areas, 104 and 105 are shown, each holding a spiraled coil of band material B rotatable on its vertical edge about a vertical axis through the center of the (coaxial) coils. The apparatus may be configured such that either coil functions as the takeup coil and the remaining coil as the payout coil. The apparatus is also reversible as to operation. In FIGS. 3, 4*a* and 5, upper table 105 is utilized for the payout coil support and lower table 104 serves as the accumulator coil support. A rotating central tower 111 (FIG. 3) having control arms 112, 113 extending from opposite sides thereof guide the band B in an inclined, S-shaped path between the lower and upper tables 104, 105. The central tower 111 serves to remove band material from the inner periphery of the lower (accumulator) coil 109 and to supply it to the inner periphery of oppositely rotating upper (payout) coil 108 in a manner to be more particularly described. Located at the reservoir station entrance and exit points are a series of driven pinch rollers 116, 117 (see FIG. 4*b*) which grip and guide the band B to a vertical orientation. When configured in the continuously renewable arrangement, similarly configured intermediate exit and entry pinch rollers 118, 119 (see FIG. 2) hold and guide band B during its diversion around turnaround sheave 600 and shear and weld station 500.

When band B enters the apparatus, the entry "wrap" is guided onto the lower table 104 where it is supported by the flanged horizontal band support rolls 110 arranged radially inward from the table 104 inner periphery. The central tower control arms 112, 113 hold and guide band B through its S-shaped path from the inside periphery of the lower coil 109 to the inside periphery of upper coil 108.

During periods when the band B is accumulating within the reservoir station 100 (accumulation mode), the central tower 111 rotates clockwise (FIG. 3) to add additional wraps to the inner periphery of both coils 109, 108, while during depletion (depletion mode) the central tower 111 rotates oppositely to reduce the number of turns on coils 109, 108, removing layers from the inner peripheries of both coils. When the takeup and payout rates are exactly equal, the central tower 111 remains motionless and only band B moves through the path. It should be noted that a single complete rotation of central tower 111 either adds or subtracts (depending on the direction of rotation) two complete coil turns, one each for lower and upper coils 109, 108. By accumulating the band in coils in this manner, extremely long lengths of band may be actively stored, taking up relatively little space in the manufacturing plant.

Operation of reservoir station 100 in the continuously renewable configuration of FIG. 2 is similar except that two accumulator/payout apparatus 102, 103 are required. They are generally stacked coaxially on a vertical axis. The lower accumulator/payout means 102 supplies band B through intermediate exit pinch roll 118, around turnaround sheave 600 and to the remote shear and weld station 500. The band B is then returned to the takeup table of the upper accumulator/payout means 103 through intermediate entry pinch roll 119.

In one modification of the apparatus (not illustrated) the reservoir station 100 may be thoroughly sprayed with a thin oil mist or other rust preventative coating from a nearby oil mist station or may be submerged in a temperature controlled oil bath, providing both protection and controlled cooling of the band B, as well as lubrication of the moving parts of the reservoir station 100.

Figure 6A:
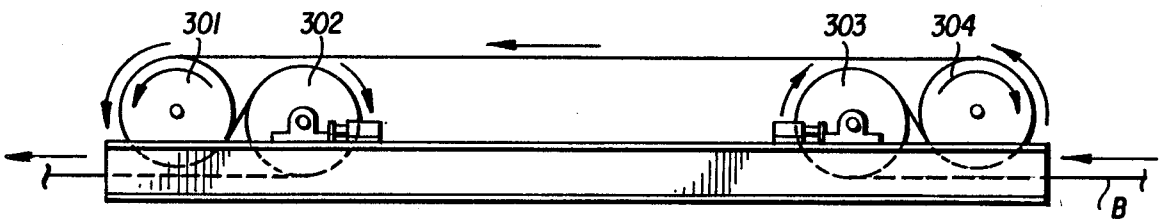
FIG. 6*a* is an elevation view of a typical band tension apparatus.
Figure 6B:
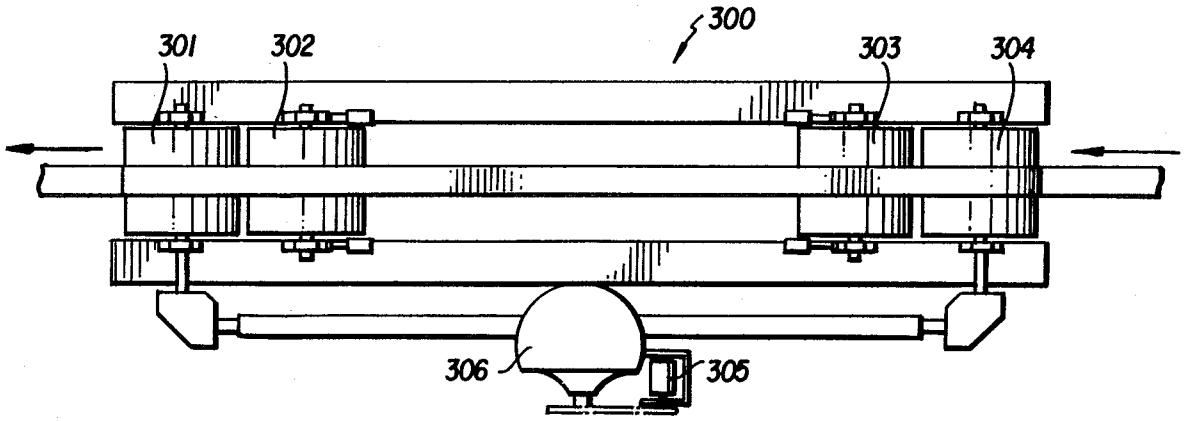
FIG. 6*b* is a plan view of a typical band tension apparatus.

Tensioning forces may be applied to the band B by, for example, any of the band tensioning mechanisms presently known in the art, including those shown schematically in FIGS. 6*a* and 6*b*. Such tension apparatus 300 comprises two pairs of rolls 301, 302 and 303, 304, the surfaces of which grip the band B in non-slipping engagement. A motor 305 or other drive means operates in known manner to rotate the roll pairs 301, 302 and 303, 304 through a limited slip differential 306 to provide tension, in our case, for removal of the band B from a casting machine associated therewith. At the same time, braking action may be applied to the mold entry tension pinch rolls to restrain movement of the band B through the tension apparatus 300 to the casting machine. The drive and braking forces may be controlled to insure proper band tension around and through the casting apparatus without transmitting substantial forces to the band reservoir 100.

Figure 7:
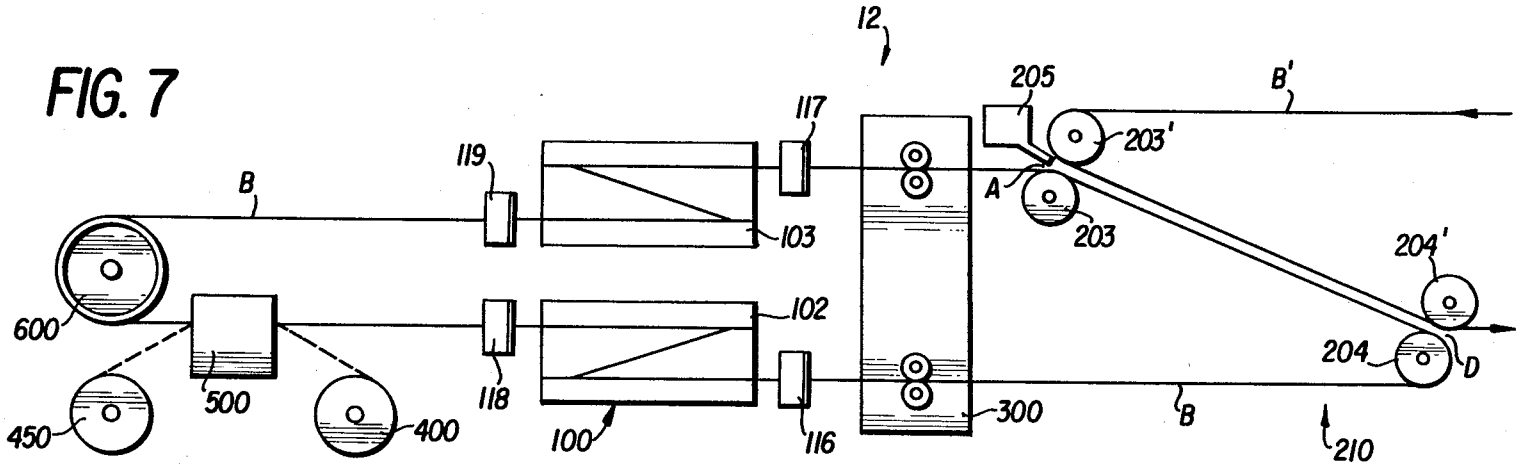
FIGS. 7, 8, and 9 are illustrative of apparatus in which alternate band-type casting machines of various types known in the art are substituted for the more standard continuous wheel-band casting machine of either FIG. 1 or FIG. 2.

A twin-belt casting machine of known construction is shown in FIG. 7, modified in accordance with the present invention and shown in the configuration identified previously as a "continuously renewable band." It will be understood that the embodiment disclosed is applicable to a continuously renewable casting machine band apparatus similar to that shown in and described in association with FIG. 2, save for the casting machine type. Multiple belt casting machines may also utilize the noncontinuously renewable configuration of FIG. 1. FIG. 7 includes a complete schematic illustration of the continuously renewable band system for one of the two bands. The portions of the second band system identical to the first band system have been mostly omitted to avoid unnecessary duplication. In FIG. 7, components of the complete casting band system on the left are identified with cardinal numbers, while duplicate components associated with the second band system, on the right, are identifiable with a cardinal number followed by the prime symbol (′). Band B is illustrated by a simple line for clarity; it is stored vertically on the tables of the reservoirs as described previously in association with FIGS. 3, 4*a*, 4*b*, and 5.

Referring now to FIG. 7 there is schematically illustrated an elongated twin-belt casting machine 12 in accordance with the present invention, comprising essentially a two stage band reservoir 100, casting machine 210, tensioning apparatus 300, spent band takeup station 400, new band supply station 450, band shear and weld station 500, and turn around sheave 600. In this embodiment, band reservoir station 100 (100′) comprises, generally, lower and upper accumulator/payout means 102, 103 (102′, 103′), band entry pinch roll 116 (116′) band exit pinch roll 117 (117′) and intermediate pinch rolls 118 (118′), 119 (119′), as well as associated apparatus omitted for clarity. Casting machine 210 comprises, generally, band B (B′), mold entry and exit wheels 203, 204 (203′, 204′), tundish 205, and further components to be described following. Tension apparatus 300 (300′) comprises groups of band tension wheels and braking means (not shown) to control the tension applied to the band. Spent band takeup station 400 (400′) comprises any conventional means to wind or roll up metal strip material of the required type and dimension. New band supply station 450 (450′) is comprised of any conventional means to supply metal strip material of the required type and dimensions, with braking means (not shown) to assist in the orderly feeding of band material to the apparatus 12. Band shear and weld station 500 (500′) has been previously described.

Two thin endless metal bands B, B′ traverse the distance between pairs of mold entry and exit wheels 203, 204 (203′, 204′) respectively, which form spaced apart, parallel, conveyor-like mold walls. A multiplicity of backup rolls or other band support means (not shown) maintain the spaced apart relationship between the two bands B, B′ against metallostatic forces. The distance between the bands determines the thickness of the casting. Casting width may be established by any of a variety of means, including for example, fixed, spaced apart mold walls or rows of small metal blocks linked together in a continuously moving series. In the latter case, the mold edge blocks may be attached to one of the belts or otherwise guided through the casting machine and maintained spaced apart from one another in correspondence to the desired casting width in the known manner. Alternatively, a further pair of parallel moving belts may form the sides of the mold. The mold angle may vary from horizontal to vertical by employing suitable band B guidance pinch rollers. Coolant (not shown), usually water or other liquid, is impinged upon the mold surfaces opposite the casting at sufficient volume and pressure to minimize band damage and to ensure proper solidification of the casting. Band B, B′ casting surfaces may be prepared in any of various ways known in the art to control the cooling rate of the solidifying metal and/or prevent "sticking" of the solidifying metal to the bands B, B′.

A tundish 205 or other means supplies molten metal to the mold. To prevent leakage of unsolidified metal at startup, a mold starter block or dam (not shown) is used to block the mold and begin casting operations.

In operation, bands B, B′ travel through the mold area concomitantly with and substantially in contact with the solidifying molten metal, exiting at the bottom of the mold at point D. Bands B, B′ pass partially around mold exit rollers 204 (204′) and through tension control mechanism 300 before reaching reservoir station 100.

It will be clear to those skilled in the art that embodiments having more than two additional bands may be handled by substantially identical apparatus arranged conveniently about the casting machine as may be dictated by individual space and other requirements and may differ somewhat in various aspects without departing from the intended scope of this invention.

Figure 8:
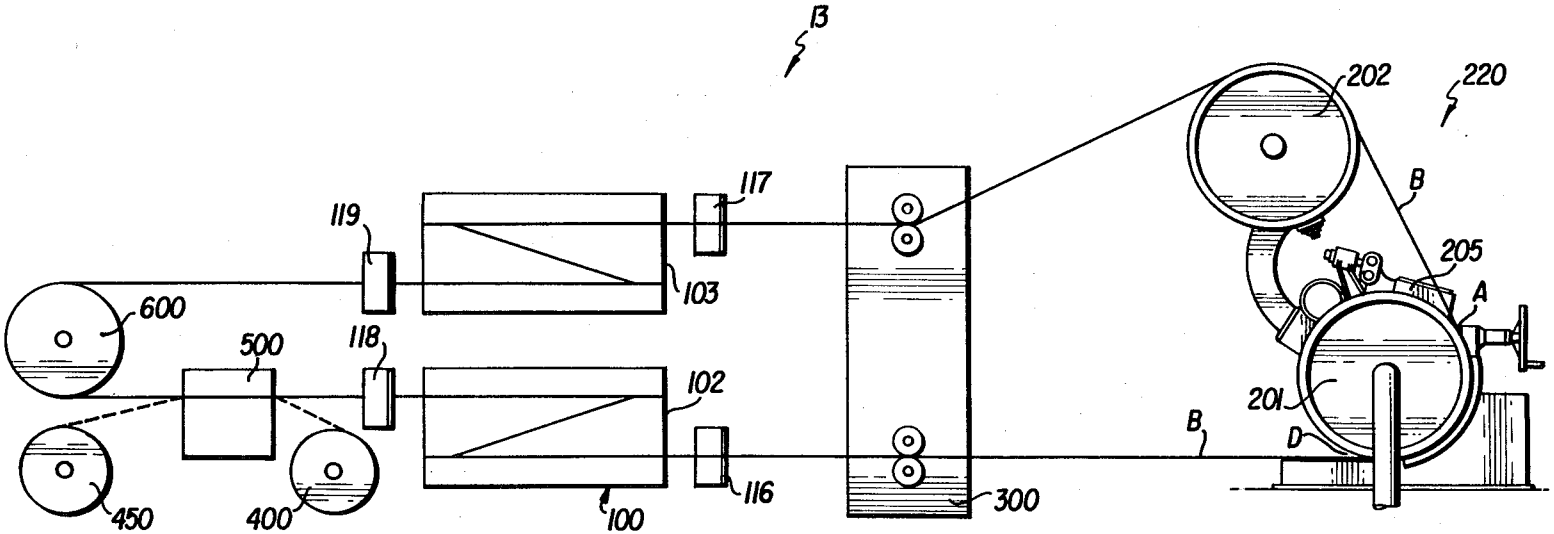

Wheel-belt casting machines of the type using only one or two tension/idler wheels in addition to the casting wheel are well-known in the continuous metal casting art, especially as used for continuous casting of non-ferrous metals. FIG. 8 illustrates a casting machine of the type wherein a single tension/idler wheel is used. Although a continuously renewable continuous casting machine band apparatus similar to FIG. 2 is shown and described, it will be understood that the FIG. 8 embodiment could be configured simiarly to a noncontinuously renewable casting machine band apparatus similar to that shown in FIG. 1.

Referring now to FIG. 8, there is shown a conventional two-wheel continuous casting machine, the belt apparatus for which has been modified for use in the continuously renewable band configuration (see FIG. 2) in accordance with this invention. Apparatus 13 comprises, essentially, casting machine 220, band B, tension control unit 300, band reservoir 100, spent band takeup station 400, new band supply station 450, band shear/-weld station 500, and turnaround sheave 600.

Save for the casting machine 220, the above apparatus have been previously described. Band reservoir 100 in the continuously renewable configuration, is comprised essentially of lower and upper accumulator/payout means 102, 103; entry and exit pinch rolls 116, 117; and intermediate exit and entry pinch rolls 118, 119. The individual accumulator/payout means 102, 103 have been described in detail in association with FIGS. 3, 4*a*, 4*b*, and 5; a similar band reservoir 100 arrangement of two stacked accumulator/payout means 102, 103 has been described in detail in association with FIG. 2. Spent band takeup station 400 and new band supply station 450 are as described in association with FIG. 1, while band shear and weld station 500 and turnaround sheave 600 are as described in association with FIG. 2.

Examining the casting machine 220 of FIG. 8, the essential components thereof include casting wheel 201, band B, tension/idler wheel 202 and tundish 205. Motive means (not shown) drive casting wheel 201. Band B tightly covers a peripheral groove in casting wheel 201 for a portion of the arc thereof, forming an arcuate, semicircular, endlessly advancing closed casting mold having an entrance at A and exiting at point D. Molten metal is delivered in conventional manner from tundish 205 into mold entry A, solidifies within the mold and exits at D as a solidified bar. Cooling means (not shown) impinge coolant upon the mold walls in a known method to ensure proper solidification. In operation, the band B exits casting machine 220 at mold exit D and passes to and through tension apparatus 300, then to and through reservoir station 100 and associated guide and drive roll means 116, 118, 119, and 117. In the continuously renewable configuration, band B is extracted from reservoir 100 and routed through a band shear and weld station 500 where the band may be severed and the ends thereof fused to new band material, to and around turnaround sheave 600 before returning to reservoir 100. Exiting reservoir 100 and exit rolls 117, the band B is guided through tension apparatus 300 to and partially around casting machine 220 tension/idler wheel 202. The tensioned band B is then routed to casting wheel 201 and around a portion of the periphery thereof to mold exit point D, completing a band cycle. Spent band takeup station 400 and new band supply station 450 are used in conjunction with shear and weld station 500 as previously described.

Figure 9:
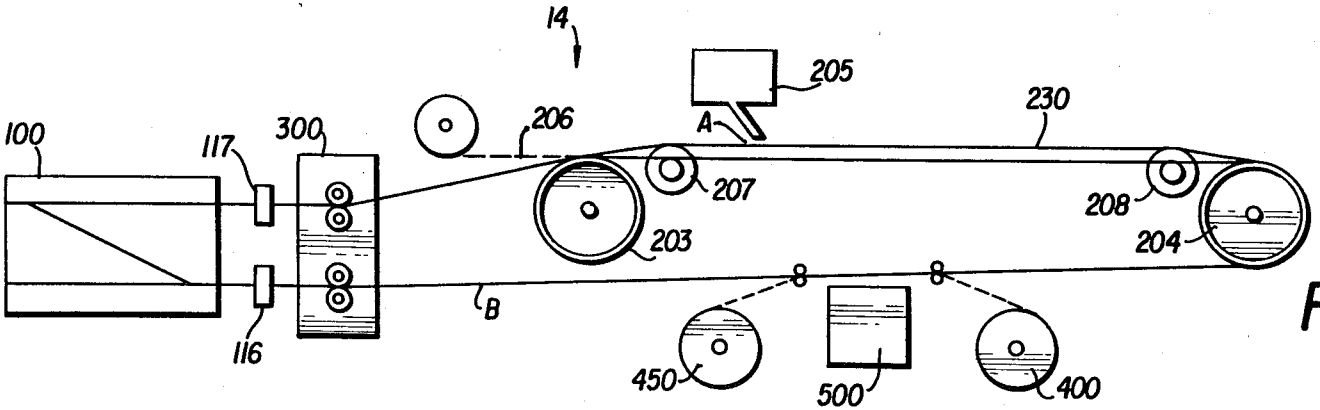

In the arrangement of FIG. 9, a continuous, horizontally extending molten metal casting apparatus 14 is shown in which a continuous band or belt B advances over a motor driven mold entry wheel 203. The band B may support an ablative material 206 (shown as a broken line) of usually the same width as the band. First shaping means 207 is provided to form the band B into an elongated U-shaped mold cross section which may be closed at the top or left open or protected in an appropriate gaseous atmosphere. One or more further shaping means 208 may be provided. Molten metal is provided from a tundish 205 or other supply means into the open mold at or near the mold beginning A. The mold is continuously advanced as the band B advances through the casting machine. At the end of the casting trough so formed, mold exit point D, the solidified metal is advanced to further production operations or to temporary storage and the band B is removed therefrom and transported to and around the second or mold exit wheel 204 where the direction of travel of the band is reversed. Band B is returned near and beyond the mold entry wheel 203 and is routed through the tension control apparatus 300, and band reservoir station 100, thence returns through the tension apparatus to the beginning point at the mold entry wheel 203.

While this invention has been described in detail with particular reference to preferred embodiments thereof, it will be understood that variations, modifications, or substitutions can be effected within the spirit and scope of the invention as described herein and defined by the appended claims.

We claim:

1. A continuous molten metal casting apparatus comprising a casting machine having a continuously advancing mold, said mold being formed by at least one endless band in conjunction with other sealing surfaces so as to provide a closed mold having entry and exit ends, means for continuously advancing said endless band along an endless path of travel, means arranged along said endless path of travel for accumulating and storing a portion of said endless band in rotating convolute coils, and means arranged adjacent said path of travel for replacing said endless band with another endless band, wherein said band replacement means arranged adjacent the path of band travel is operative for replacing said endless band without interrupting the endless band along that portion of the endless path of travel where the endless band forms a closed continuously advancing mold.

2. A method of using a metallic strip accumulator means in a continuous molten metal casting process comprising the steps of:

(a) casting molten metal into a continuously advancing mold portion of a casting machine wherein at least one of the mold surfaces is formed by a continuously advancing elongated endless band in conjunction with other sealing surfaces so as to provide a closed mold having entry and exit ends, (b) cooling said mold thereby causing the molten metal to at least partially solidify, (c) separating the endless band from the mold exit end of the closed portion of the mold, (d) positively advancing said continuously advancing band along a predetermined band path which includes a first band tensioner means, (e) advancing the mold and continuously withdrawing the cast bar from the mold while molten metal is poured continuously into the mold, (f) routing said continuously advancing endless bend along a band path which path includes a metallic strip accumulator means wherein a variable length of continuous elongated casting band may be stored in rotating convolute coils while advancing therethrough, (g) cooling the at least partially solidified bar until solidification is effected, (h) returning said continuously advancing endless casting band through a second band tensioner means to the casting machine mold entry end so as to maintain a constant band tension between said closed mold entry and exit ends, further characterized by storing at least one continuously advancing elongated band in a plurality of strip accumulator means and the steps of:

(i) arresting movement of the continuously advancing elongated band through a band shear and weld station by gripping said band in a first clamp means and a second clamp means, (j) continuously accumulating the continuously advancing elongated band material in a first metallic strip accumulator means preceding said band shear and weld station along the path of said band, (k) continuously dispensing stored band material from a second metallic strip accumulator means following said band shear and weld station along the path of said band, and (l) renewing the continuous casting band through conventional operation of the band shear and weld station apparatus and releasing the first and second band clamping means.

3. In a continuous molten metal casting method of the type wherein:

(a) molten metal is continuously cast on a casting machine having continuously advancing mold parts wherein at least one of said mold parts is formed by (b) continuously advancing a thin elongated strip of casting band material in contact with other continuously advancing mold parts, (c) tensioning the continuously advancing elongated casting band in a band tensioning means, the improved method of renewing said elongated casting band consisting of the further steps of:

(d) storing a continuously advancing elongated portion of said band in rotating convolute coils, (e) arresting movement of a portion of the casting band and severing the old band, (f) interchanging a new band from a separate supply source with the old band by joining the new band leading end to the old band trailing end and guiding the new band along the old band path, (g) forming the new band material into an endless casting band by severing the new casting band from the supply source and joining the ends of the new casting band, (h) releasing the new endless casting band for normal operation.

4. The method of renewing an elongated metal casting band which continuously advances along a band path of a casting machine during continuous casting operations comprising the steps of:

(a) storing an elongated metal casting band, which band continuously advances along a band path, in at least two pairs of rotating convolute coils disposed along said band path, (b) arresting movement of a portion of the band between a first pair of said rotating convolute coils and a second pair of said rotating convolute coils with a first clamp means and a spaced apart second clamp means, (c) accumulating the elongated metal casting band in said first pair of rotating convolute coils, (d) paying out the elongated metal casting band from said second pair of rotating convolute coils, (e) severing the old band at the point of arrested movement between the first and second clamp means and joining a new band from a separate supply source to the old band trailing end, (f) releasing the second clamp means to allow movement of the old band trailing end joined to the leading end of the new band and guiding the new band along the old band path at a rate greater than that of casting so as to accumulate the new band in the second pair of rotating convolute coils, (g) withdrawing the old band by its severed leading edge to a separate storage location after releasing the first clamp means to allow free movement of the old band, (h) arresting movement of the trailing end of the new band at a point between said first and second pairs of rotating convolute coils and passing the leading end of the new band past the aforesaid point, (i) arresting movement of the leading end of the new band with a first clamp means before and with a second clamp means after the aforesaid point and severing the band therebetween, (j) joining the leading end of the new band to the trailing end of the new band to form an endless band, (k) releasing movement of the new endless band for normal operation.

5. The method of claim 3 or 4 wherein a plurality of elongated metal casting bands employed by a casting machine may be continuously renewed.

6. The method of claims 3 or 4 wherein a reverse twist is applied to the end of one band before final joining thereof, resulting in an endless elongated band in the known "Mobius Strip" configuration.

7. A continuous molten metal casting apparatus comprising a casting machine having a continuously advancing mold, said mold being formed by at least one endless band in conjunction with other sealing surfaces so as to provide a closed mold having entry and exit ends, and means for continuously advancing said endless band along an endless path of travel, the improvement comprising:

means arranged along said endless path of travel for accumulating and storing a portion of said endless band in rotating convolute coils, means arranged adjacent said path of travel for replacing said endless band with another endless band, severing means adjacent the path of band travel for severing the endless band;

take up means adjacent the path of band travel for taking up the severed band and removing it from the path of band travel as it passes therealong;

supply means adjacent the path of band travel for introducing a length of band material having a leading end and a trailing end into the path of band travel; and uniting means adjacent the path of band travel for permanently joining the leading and trailing ends of said length of band to form a replacement endless band, wherein said band replacement means arranged adjacent the path of band travel is operative for replacing said endless band without interrupting the endless band along that portion of the endless path of travel where the endless band forms a closed continuously advancing mold.

8. A method of using a metallic strip accumulator means in a continuous molten metal casting process comprising the steps of:

(a) casting molten metal into a continuously advancing mold portion of a casting machine wherein at least one of the mold surfaces is formed by a continuously advancing elongated endless band in conjunction with other sealing surfaces so as to provide a closed mold having entry and exit ends, (b) cooling said mold thereby causing the molten metal to at least partially solidify, (c) separating the endless band from the mold exit end of the closed portion of the mold, (d) positively advancing said continuously advancing band along a predetermined band path which includes a first band tensioner means, (e) advancing the mold and continuously withdrawing the cast bar from the mold while molten metal is poured continuously into the mold, (f) routing said continuously advancing endless band along a band path which path includes a metallic strip accumulator means wherein a variable length of continuous elongated casting band may be stored in rotating convolute coils while advancing therethrough, (g) cooling the at least partially solidified bar until solidification is effected, and (h) returning said continuously advancing endless casting band through a second band tensioner means to the casting machine mold entry end so as to maintain a constant band tension between said closed mold entry and exit ends, wherein the at least partially solidified cast bar and the endless band are together removed from the casting mold exit and wherein the at least partially solidified cast bar is supported and guided along the band path by the continuously advancing band prior to separation of the continuously advancing band and the at least partially solidified cast bar, further characterized by storing at least one continuously advancing elongated band in a plurality of strip accumulator means and the steps of:

(i) arresting movement of the continuously advancing elongated band through a band shear and weld station by gripping said band in a first clamp means and a second clamp means, (j) continuously accumulating the continuously advancing elongated band material in a first metallic strip accumulator means preceding said band shear and weld station along the path of said band, (k) continuously dispensing stored band material from a second metallic strip accumulator means following said band shear and weld station along the path of said band, (l) renewing the continuous casting band through conventional operation of the band shear and weld station apparatus and releasing the first and second band clamping means.

9. A method of using a metallic strip accumulator means in a continuous molten metal casting process comprising the steps of:

(a) casting molten metal into a continuously advancing mold portion of a casting machine wherein at least one of the mold surfaces is formed by a continuously advancing elongated endless band in conjunction with other sealing surfaces so as to provide a closed mold having entry and exit ends, (b) cooling said mold thereby causing the molten metal to at least partially solidify, (c) separating the endless band from the mold exit end of the closed portion of the mold, (d) positively advancing said continuously advancing band along a predetermined band path which includes a first band tensioner means, (e) advancing the mold and continuously withdrawing the cast bar from the mold while molten metal is poured continuously into the mold, (f) routing said continuously advancing endless band along a band path which path includes a metallic strip accumulator means wherein a variable length of continuous elongated casting band may be stored in rotating convolute coils while advancing therethrough, (g) cooling the at least partially solidified bar until solidification is effected, and (h) returning said continuously advancing endless casting band through a second band tensioner means to the casting machine mold entry end so as to maintain a constant band tension between said closed mold entry and exit ends, wherein the at least partially solidified cast bar and the endless band are together removed from the casting mold exit and wherein the at least partially solidified cast bar is supported and guided along the band path by the continuously advancing band prior to separation of the continuously advancing band and the at least partially solidified cast bar, and wherein a casting machine having at least one pair of parallel continuously advancing elongated bands to form at least two of the mold walls is used to cast the molten metal, further characterized by storing at least one continuously advancing elongated band in a plurality of strip accumulator means and the steps of:

(i) arresting movement of the continuously advancing elongated band through a band shear and weld station by gripping said band in a first clamp means and a second clamp means, (j) continuously accumulating the continuously advancing elongated band material in a first metallic strip accumulator means preceding said band shear and weld station along the path of said band, (k) continuously dispensing stored band material from a second metallic strip accumulator means following said band shear and weld station along the path of said band, (l) renewing the continuous casting band through conventional operation of the band shear and weld station apparatus and releasing the first and second band clamping means.

* * * * *